US008915615B2

(12) United States Patent
Sell et al.

(10) Patent No.: US 8,915,615 B2
(45) Date of Patent: Dec. 23, 2014

(54) SHUTTER LOCK

(75) Inventors: Lincoln Sell, Christchurch (NZ); Dylan Filbee, Christchurch (NZ); Duncan Dore, Auckland (NZ); Bruce McCallum, Auckland (NZ); Andrew Nichols, Auckland (NZ)

(73) Assignee: Koninklijke Philips N.V., Eindhoven (NL)

( * ) Notice: Subject to any disclaimer, the term of this patent is extended or adjusted under 35 U.S.C. 154(b) by 463 days.

(21) Appl. No.: 13/254,977

(22) PCT Filed: Mar. 5, 2010
(Under 37 CFR 1.47)

(86) PCT No.: PCT/IB2010/050971
§ 371 (c)(1),
(2), (4) Date: Apr. 4, 2012

(87) PCT Pub. No.: WO2010/100628
PCT Pub. Date: Sep. 10, 2010

(65) Prior Publication Data

US 2012/0300464 A1 Nov. 29, 2012

Related U.S. Application Data

(60) Provisional application No. 61/158,108, filed on Mar. 6, 2009.

(30) Foreign Application Priority Data

Mar. 6, 2009 (AU) ..... 2009200881

(51) Int. Cl.
*F21V 11/18* (2006.01)
*F21V 17/16* (2006.01)
*F21W 131/406* (2006.01)

(52) U.S. Cl.
CPC ..... *F21V 11/18* (2013.01); *F21W 2131/406* (2013.01); *F21V 17/162* (2013.01)
USPC ..... 362/283; 362/277; 362/321; 362/322

(58) Field of Classification Search
USPC ..... 362/16, 18, 228, 257, 269, 277, 279, 362/281, 283, 317, 321, 322, 323; 396/495–498, 510
See application file for complete search history.

(56) References Cited

U.S. PATENT DOCUMENTS 2,076,240 A * 4/1937 Levy ..... 362/281
2,361,765 A * 10/1944 Grimes ..... 362/317

(Continued)

FOREIGN PATENT DOCUMENTS

FR 635535 A1 3/1928
FR 2383392 A1 10/1978
WO 9636834 A1 11/1996

*Primary Examiner* — Hargobind S Sawhney

(57) ABSTRACT

The present invention relates to a lighting apparatus or a shutter assembly for a lighting apparatus comprising: a light path for passage of light emanating from a lamp, at least one shutter plate 130-133 moveable into a position external to or at least partially across the light path, and a rotatable shutter lock 180 being rotatable to directly or indirectly generate a friction force on the shutter plate 130-133, wherein the friction force generated on the shutter plate 130-133 is dependent on the rotational position of the shutter lock 180 and in at least one rotational position there is sufficient frictional force to retain the shutter plate 130-133 in the position external to or across the light path.

16 Claims, 9 Drawing Sheets

(56) References Cited

U.S. PATENT DOCUMENTS

| | | | | | |
|---|---|---|---|---|---|
| 2,439,330 | A | * | 4/1948 | Zander | 359/234 |
| 2,465,578 | A | * | 3/1949 | Czarnikow et al. | 396/510 |
| 3,307,028 | A | * | 2/1967 | Bentham | 362/281 |
| 3,727,531 | A | * | 4/1973 | Baab | 396/510 |
| 4,208,100 | A | * | 6/1980 | Bischl | 359/234 |
| 4,210,955 | A | * | 7/1980 | Labrum | 362/321 |
| 4,257,086 | A | * | 3/1981 | Gulliksen | 362/279 |
| 4,468,720 | A | * | 8/1984 | Arai | 362/281 |
| 4,843,528 | A | * | 6/1989 | Pearce-Harvey et al. | 362/277 |
| 5,179,400 | A | * | 1/1993 | Maeng | 396/546 |
| 5,510,969 | A | * | 4/1996 | Rodger et al. | 362/321 |
| 5,803,571 | A | * | 9/1998 | McEntyre et al. | 362/18 |
| 6,550,939 | B2 | * | 4/2003 | Reinert | 362/321 |
| 7,108,401 | B1 | * | 9/2006 | Kane et al. | 362/321 |
| 7,350,941 | B2 | * | 4/2008 | Hunt | 362/321 |
| 7,703,948 | B2 | * | 4/2010 | Dalsgaard | 362/281 |

* cited by examiner

SHUTTER LOCK

FIELD OF THE INVENTION

The present invention relates to shutters on lighting apparatus, and in particular to a system and method for locking the shutters on a lighting apparatus in position.

BACKGROUND

Lighting apparatus, such as luminaries and architectural lighting, comprise an outer generally cylindrical housing that can be suspended from a lighting rig or similar. An illumination source (such as a lamp) is also provided that projects light towards a lens in the housing. The light exits the lens and illuminates the desired area. Shutters are generally placed within the lighting apparatus in the path of the light beam to alter the shape of the beam and in turn alter the shape of the projection of light on the desired area.

Shutters are usually positioned to suit different lighting scenarios. Once they have been placed in a specific positioned, it is desirable to retain them fixed in that position to prevent them from easily moving (e.g. dropping or sliding) due to gravity, normal building vibrations heat and/or accidental human intervention.

SUMMARY OF THE INVENTION

The present invention provides an improved mechanism for retaining the shutters of a lighting apparatus in place, or to at least provide the public with a useful choice.

In one aspect the present invention may be broadly said to consist in a shutter assembly for a lighting apparatus, the shutter assembly comprising:

- a light path for passage of light emanating from a light source, such as a lamp in a lighting apparatus,
- at least one shutter plate moveable into a position external to or at least partially across the light path, and
- a rotatable shutter lock being rotatable to directly or indirectly generate a friction force on the shutter plate,
- wherein the friction force generated on the shutter plate is dependent on the rotational position of the shutter lock and in at least one rotational position there is sufficient frictional force to retain the shutter plate in the position external to or across the light path.

Since the friction force is dependent on the rotational position of the shutter lock, it is an advantage of the present invention the friction force can be gradually increased by rotation of the shutter plate to reach a frictional force that will retain the shutter plate in position.

Optionally the shutter assembly has an axial direction and the friction force is generated by the rotatable shutter lock retaining the shutter plate directly or indirectly against a support surface fixed in the axial direction.

Optionally the shutter plate is retained directly or indirectly against the support surface by setting the displacement of the shutter plate in the axial direction relative to the support surface.

Optionally the rotational position of the shutter lock plate sets the displacement of the shutter plate in the axial direction.

Optionally the at least one rotational position is a lock position. In the lock position, the rotational position of the shutter lock sets the displacement of the shutter plate such that the friction force is sufficient to retain the shutter plate in the position external to or across the light path.

Optionally the shutter lock comprises a rotatable plate which bears directly or indirectly against the shutter plate, wherein the rotational position of the rotatable plate sets the displacement of the shutter plate in the axial direction.

Optionally the shutter lock further comprises a diverter plate adjacent the rotatable plate, the diverter plate bears directly or indirectly against the shutter plate, and at least one of the rotatable plate and the diverter plate comprises at least one camming surface that bears against the other plate, wherein rotation of the rotatable plate causes the camming surface to set a displacement of at least the diverter plate in the axial direction, which in turn sets the displacement of the shutter plate in the axial direction. Optionally at least one of the rotatable plate and the diverter plate comprises a corresponding formation for each camming surface.

Optionally each camming surface bears against a corresponding formation of the other plate.

Optionally there are a plurality of radially and/or circumferentially spaced camming surfaces and a plurality of radially and/or circumferentially spaced corresponding formations.

Optionally, each camming surface is a ramped protrusion such as a dimple and corresponding formation is a twin diameter aperture, wherein for each aperture the larger diameter engages with a respective protrusion and upon relative rotation of the rotatable plate and diverter plate, for each aperture the smaller diameter partially engages with the respective protrusion to displace the rotatable plate from the diverter plate.

Alternatively, each camming surface is a ramp and the corresponding formation is a spring tab, wherein relative rotation of the rotatable plate and diverter plate causes each tab to slide up or down a corresponding ramp to displace the rotatable plate from the diverter plate.

Alternatively, the rotatable plate comprises at least one camming surface that bears against a corresponding formation wherein rotation of the rotatable plate causes the camming surface to move relative to the corresponding formation to set the displacement of the shutter plate in the axial direction.

Optionally the axial direction is parallel to the axis of rotation of the shutter lock plate.

Optionally the shutter lock comprises a central aperture that forms part of the light path.

Optionally there are two pairs of opposed shutter plates, each pair of plates lying within a plane parallel to that of the other pair of plates across the light path and parallel to that of the shutter lock plate, and each plate of each pair being moveable within its respective plane and in the first axial direction. Optionally when the opposed shutter plates of at least one pair brought into contact with one another, the light path is blocked.

Optionally when the opposed shutter plates of each pair are aligned and brought into contact, the two pairs of shutter plates lie in a mutually perpendicular orientation. Movement of at least one plate from each pair creates a gap between each pair of opposed plates for a light beam to traverse through.

Optionally the shutter assembly also comprises a first separator plate between the two pairs of opposed shutter plates, and a second separator plate between one of the pairs of opposed shutter plates and the surface, each of said first and second separator plates having a central aperture for a light beam to traverse through.

Optionally the surface forms part of a shutter housing.

In another aspect the present invention may be said to consist in a shutter assembly, the shutter assembly comprising:

- a light path for passage of light emanating from a light source of the lighting apparatus, at least one shutter plate moveable into a position external to or at least partially across the light path, and a rotatable shutter lock being rotatable to directly or indirectly generate a friction force on the shutter plate, wherein the friction force generated on the shutter plate is dependent on the rotational position of the shutter lock and in at least one rotational position there is sufficient frictional force to retain the shutter plate in the position external to or across the light path.

In this specification where reference has been made to patent specifications, other external documents, or other sources of information, this is generally for the purpose of providing a context for discussing the features of the invention. Unless specifically stated otherwise, reference to such external documents is not to be construed as an admission that such documents, or such sources of information, in any jurisdiction, are prior art, or form part of the common general knowledge in the art.

The term "comprising" as used in this specification means "consisting at least in part of". Related terms such as "comprise" and "comprised" are to be interpreted in the same manner.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

BRIEF DESCRIPTION OF THE FIGURES

Embodiments of the invention will be described with reference to the following drawings, of which.

DETAILED DESCRIPTION OF EMBODIMENTS

A shutter assembly for a lighting apparatus will be described with reference to two embodiments.

The shutter assembly of each embodiment forms part of an overall lighting apparatus. For example, the lighting apparatus could be a luminaire or architectural lighting, although the assembly could be used in any suitable lighting apparatus. The assemblies can also be integrated into existing lighting apparatus to provide a means by which to adjust the shape of the light beam exiting the lighting apparatus. In this specification, embodiments of shutter assemblies on their own will be described, but it will be appreciated that other embodiments including a lighting apparatus employing the shutter assembly of the present invention are not to be excluded from the scope of protection.

Figure 1:
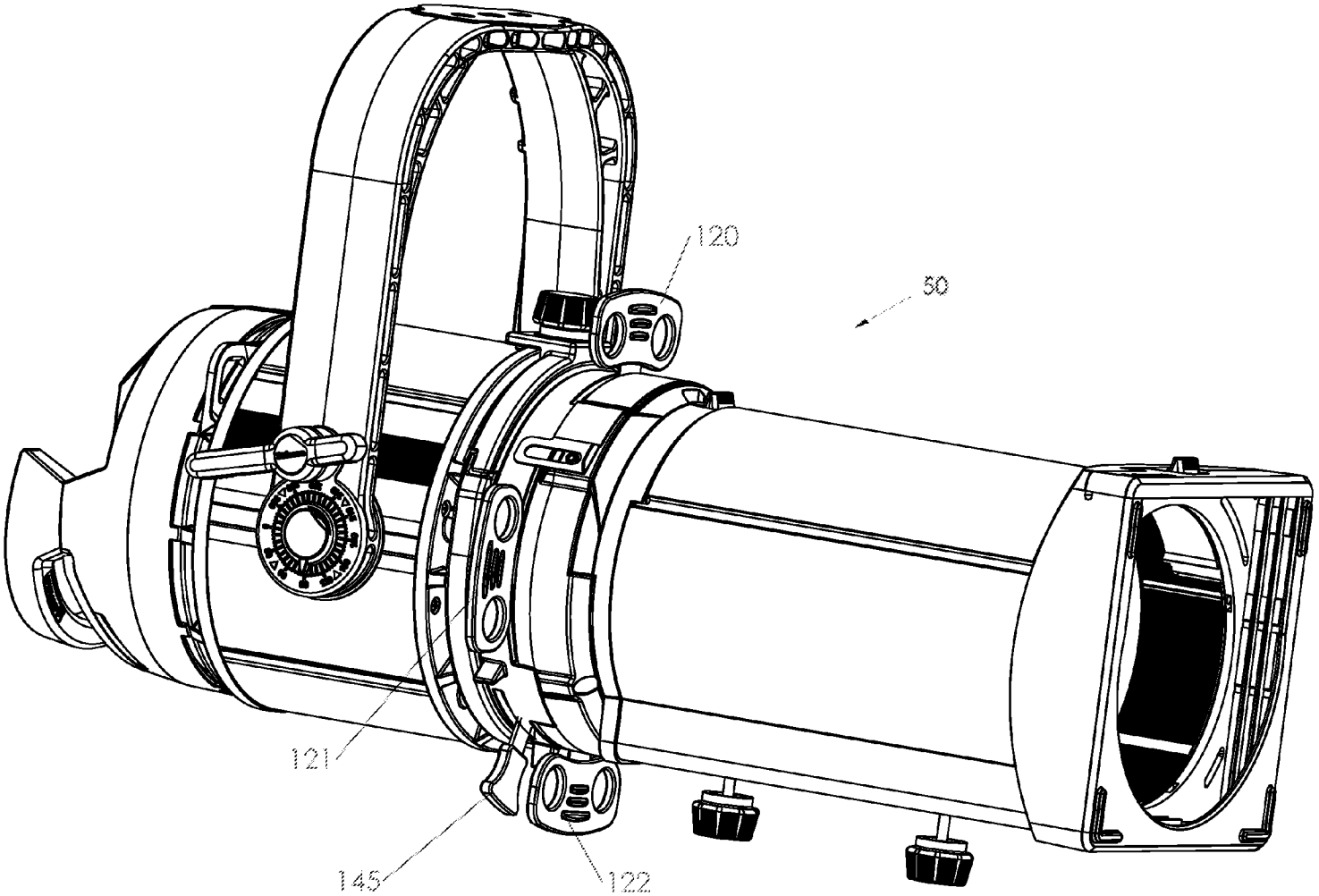
FIG. 1 is a perspective view of a lighting apparatus.

FIG. 1 shows a lighting apparatus 50 that could use or contain a shutter assembly of the present invention.

Figure 2:
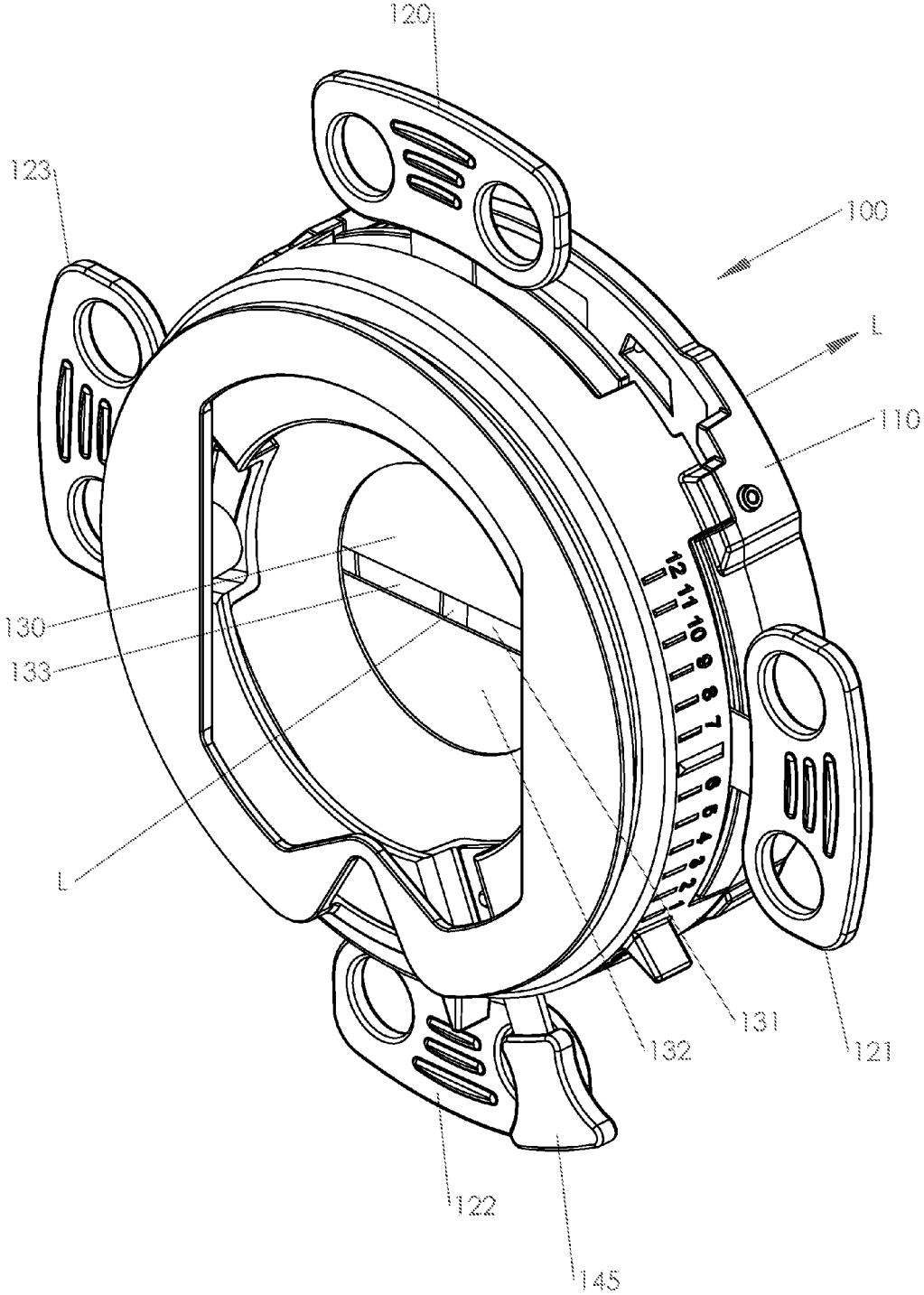
FIG. 2 is a perspective view of a first embodiment of a shutter assembly for the lighting apparatus of FIG. 1.

FIGS. 2-5 show a first embodiment of a shutter assembly 100 of the present invention. FIG. 2 shows the shutter assembly 100 in the assembled form. The assembly 100 comprises a housing 110 which retains the mechanism of the shutter assembly 100. The housing 110 can be a separate housing specifically formed for the shutter assembly 100, or it can be part of the housing of the lighting apparatus employing the shutter assembly 100. The housing 110 is generally cylindrical in shape and has a longitudinal axis and more generally a longitudinal (axial) direction L.

Figure 3:
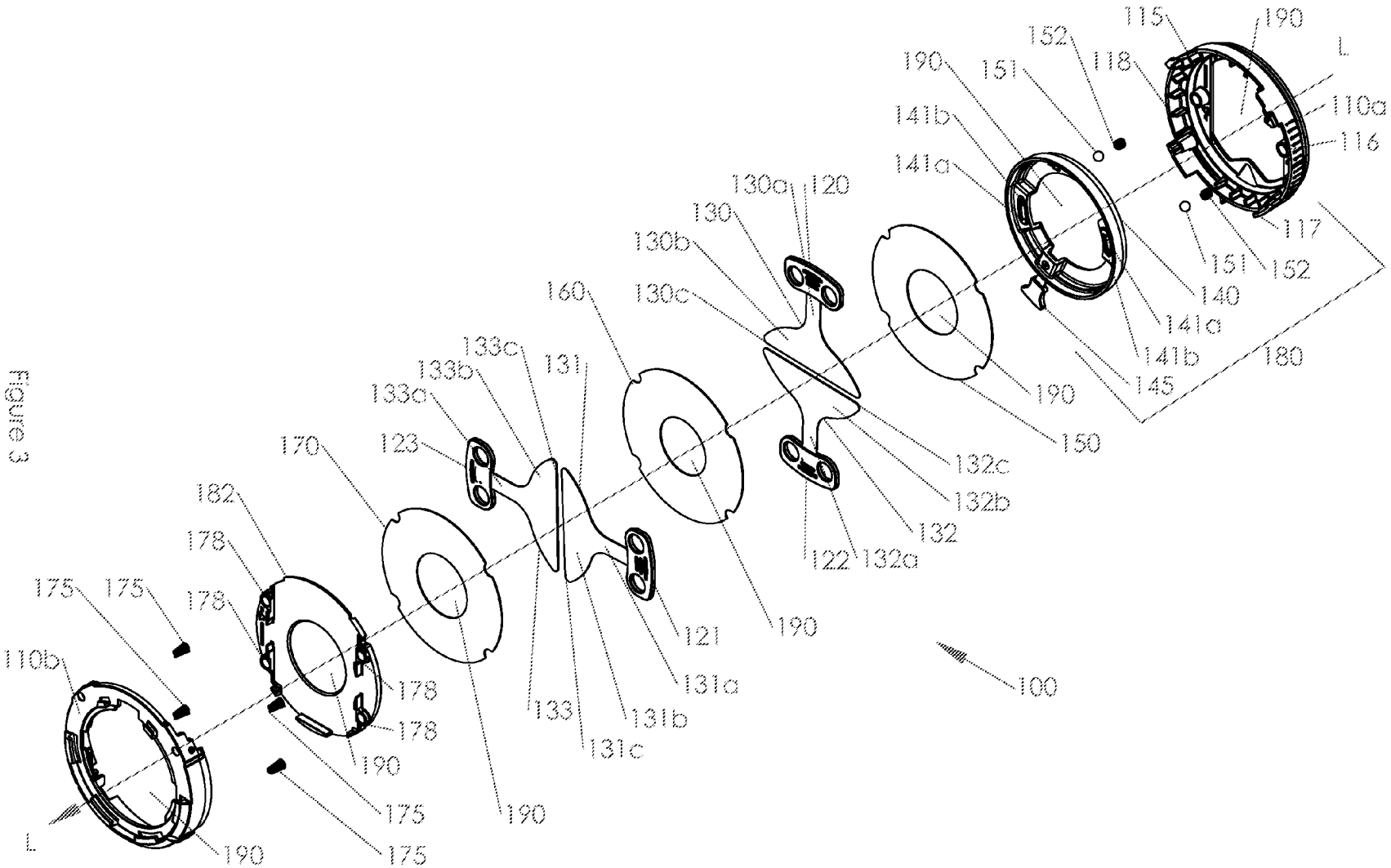
FIG. 3 is an exploded isometric frontal view of the shutter assembly of FIG. 2.

FIG. 3 shows the internal components housed in the shutter assembly 100. The housing 110 is formed as two disk-like surfaces 110*a* and 110*b* that can be coupled together to form the cylindrical assembly of the housing 110. The housing 110 retains a shutter lock 180 (formed from rotation (lock) plate 140, ball bearings 151 and helical springs 152), shutter plates 130-133 which can be of any suitable form of shutter plate known in the art, and first and second separator plates 160 and 170 respectively, and housing casting plate 182. The housing 110 and the plates 140, 150, 160 and 170 retained within the housing contain apertures 190 for allowing a light beam emanating from a lamp (not shown) to traverse through these apertures 190 along a light path.

The housing casting plate 132 allows lighting accessories to be used within the lighting apparatus 50, such as gobos and iris (not shown). The housing casting plate 182 acts as a guide for the accessories and alo spreads the clamping load onto the shutter plate assembly.

Shutter plates 130-133 are moveable to be external to (completely out of) or at least partially across the path of the light beam (light path) to alter the shape of the light beam which exits the shutter assembly 100. Shutter plates 130, 132 are moveable via movement of handles 120, 122 respectively, and are moveable independently of each other. Shutter plates 131, 133 are moveable via movement of handles 121, 123 respectively and are also moveable independently of each other. Housing 110 is provided with apertures 115-118 (see also FIG. 6) for allowing the handles 120-123 to extend beyond the housing 110 once the shutter assembly 100 has been assembled (as shown in FIG. 2). Apertures 115-118 are generally circumferentially spaced about the outer peripheral wall of housing 110 and are of a length and width dependent on the degree of movement required for shutter plates 130-133 in rotation and axial displacement. Once the shutter plates 130-133 have been moved to their desired position, the shutter lock 180 can be used to retain the shutter plates 130-133 into position.

As shown in FIG. 3 shutter plates 130-133 are arranged in two pairs of opposed shutter plates 130, 132 and 131, 133. Each pair of plates lie within a plane parallel to that of the other pair of plates and also to that of the shutter lock 180. Each plate of each pair 130, 132 and 131, 133 is moveable within its respective plane and also in the axial direction L (and in the opposite direction). Optionally when the opposed shutter plates of at least one of the pairs are aligned and brought into contact with one another, the light beam is blocked from exiting the assembly 100. Then, movement of at least one plate from each closed pair creates a gap between each pair of opposed plates for a light beam to traverse through.

The shape of each shutter plate will now be described with reference to shutter plate 130. It will be appreciated however that the rest of the shutter plates have the same general shape. Shutter plates 130-133 comprise a neck portion e.g. 130*a* for shutter plate 130, which extends from the corresponding handle 120 into a light blocking portion 130*b*, the light blocking portion terminating at an end 130*c*. In one form the light blocking portion (and more generally the shutter plate) terminates at a linear end e.g. 130*c*. It will be appreciated however that the shutter plate can terminate with any profile. Optionally the other shutter plate in that pair terminates in a complementary profile such that when the two shutter plates opposing one another are aligned and brought into contact, the gap initially formed between them is closed to completely block any light traversing through the shutter assembly 100.

Optionally the neck portion is narrower in width than the light blocking portion to give the shutter plate a high level of rotational manoeuvrability within its respective aperture. It will be appreciated however that the size of the neck portion is dependent on the application and the level of manoeuvrability of the shutter plate that is required.

In this embodiment when the ends of each pair of shutter plates 130*c*, 132*c* and 131*c*, 133*c* are parallel to one another, plates 130 and 132 are orientated predominantly vertically, and plates 131 and 133 are orientated predominantly horizontally.

The operation of the shutter lock 180 to lock the shutter plates 130-133 in the position they have been moved to will now be described with reference to FIGS. 3-5. The shutter lock 180 is rotatable to generate a friction force on the shutter plates and in particular, at least one rotational position of the shutter lock 180, the lock position, generates sufficient frictional force to lock the shutter plates 130-133 in position (either external to or across the path of the light beam). Rotating the shutter lock 180 sets the displacement of the shutter plates 130-133 (and the rest of the plates in the assembly) in the axial direction L. That is, rotating the shutter lock 180 to the lock position sets the displacement of the shutter plates 130-133 in the axial direction L (and the rest of the plates in the shutter assembly) by an amount which generates sufficient frictional force to retain the shutter plates 130-133 (and the rest of the plates in the assembly) against a fixed support surface in the axial direction L. In this embodiment, the fixed support surface is provided by the housing 110*b* as shown in FIG. 2.

FIG. 3 shows a first embodiment of the invention with the shutter lock 180 comprising the rotatable plate 140, ball bearings 151 and springs 152. The rotatable plate 140 and the housing 110*a* are rotatable relative to one another. In this embodiment the rotatable plate 140 is rotatable about the axis L, and the housing 110*a* is fixed from rotation about the axis L. The diverter plate 150 bears against shutter plates 130 and 132. The rotational position of the rotatable plate 140 sets the displacement of rotatable plate 140 in the axial direction L which in turn sets the displacement of the diverter plate 150, and in turn the first pair of shutter plates 130 and 132, which in turn displaces the adjacent first separator plate 160, which displaces adjacent shutter plates 131 and 133, and which finally displaces the second separator plate 170 and housing casting plate 182. The housing casting plate 182 bears against housing 110*b* which prevents the plates from further displacement. In this way, a frictional force is generated between all the adjacent plates and the housing 110*b* which retains the shutter plates 130-133. In the lock position, the rotatable plate 140 is rotated to a position which displaces the diverter plate 150 by an amount sufficient to generate enough friction to lock the shutter plates 130-133 in the radial position they had been moved to prior to locking. Rotation handle 145 on rotatable plate 140 can be used to rotate the rotatable plate 140 in and out of the lock position. Housing 110*a* comprises a corresponding aperture for allowing rotation handle 145 to protrude through housing 110.

To convert rotational motion into axial displacement the rotatable plate 140 comprises at least one camming surface and rotation of the rotatable plate 140 causes the camming surface to set the displacement of the rotatable plate 140. This is achieved by having a corresponding formation on the diverter plate 150 or corresponding separate formations for each camming surface to bear against. In FIG. 3, the rotatable plate 140 is shown to have a plurality of circumferentially spaced (additionally or alternatively radially spaced) camming surfaces in the form of integrally formed ramps 141. The corresponding separated formations are provided in the form of a pair of components being a ball bearing 151 that sits in the open top of a helical spring 152. The ball bearing 151 bears against the rotatable plate 140 and the spring 152. The springs 152 bear against the ball bearing 151 and the housing 110*a*. The springs 152 contribute to the pretensioning of the shutter assembly 100.

Figure 4:
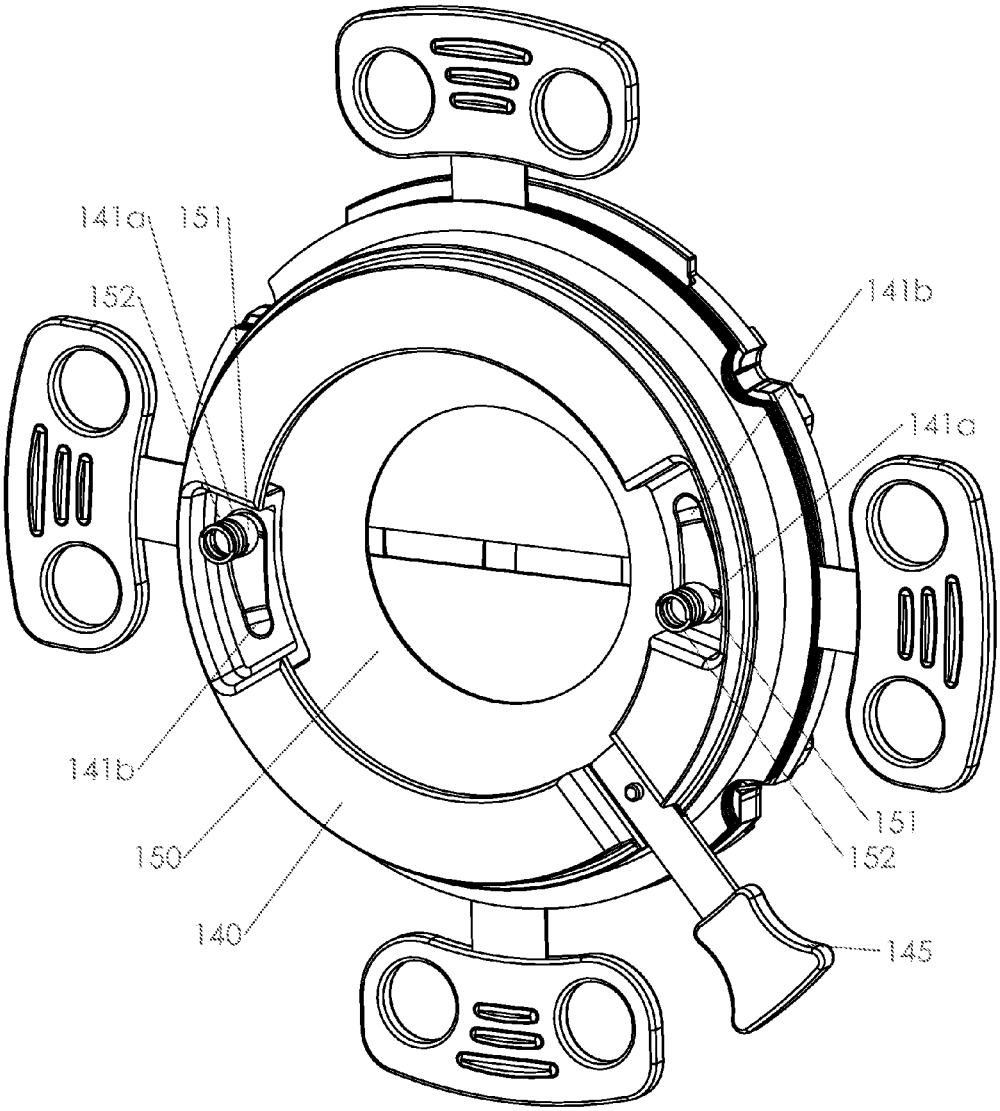
FIG. 4 is a perspective rear view of the shutter assembly of FIG. 2 in an unlocked state and without the housing.
Figure 5:
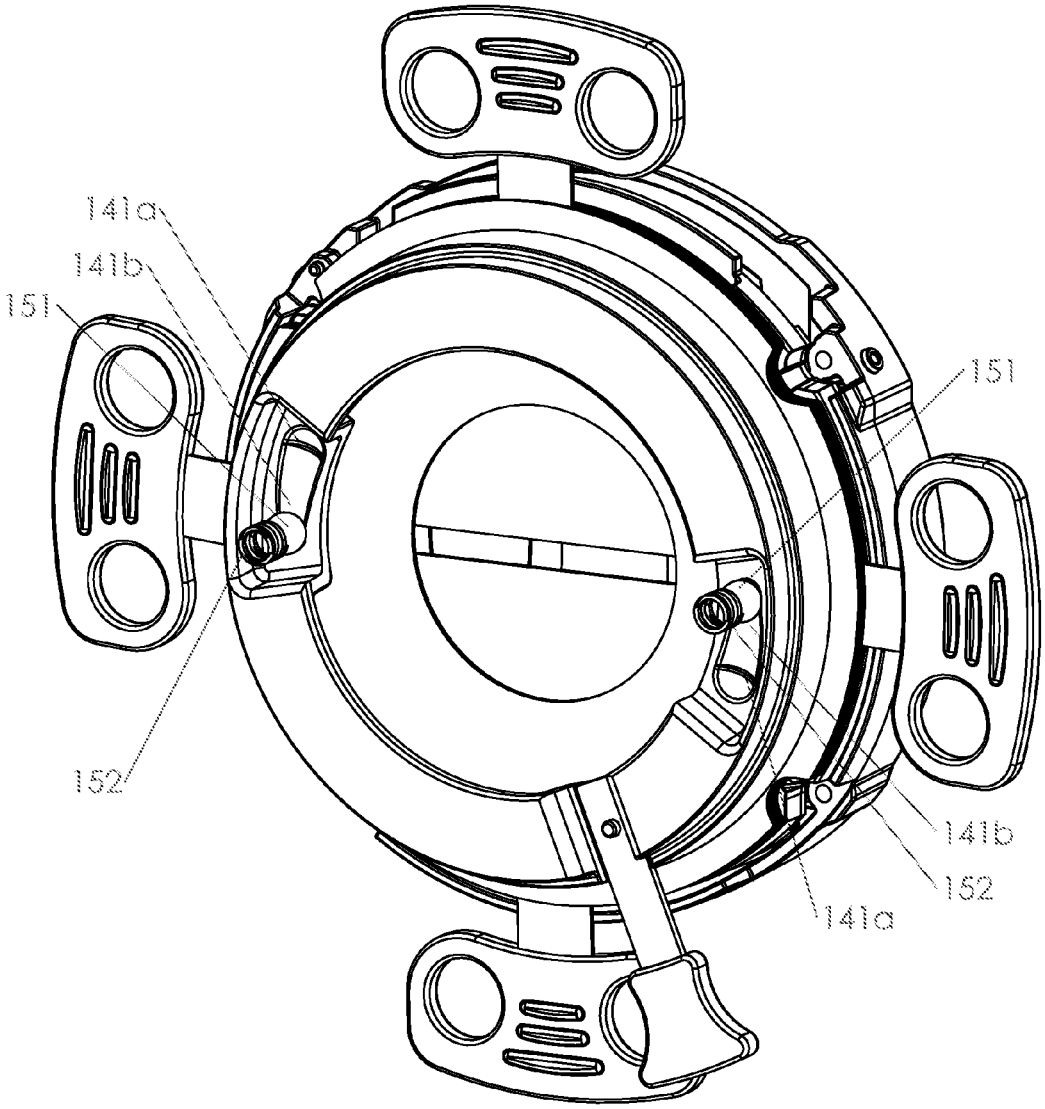
FIG. 5 is a perspective rear view of the shutter assembly of FIG. 2 in a locked state and without the housing.

In the unlocked position shown in FIG. 4, where the shutter plates 130-133 are free to move to alter the shape of the light beam, the ball bearings 151 bear against the deepest portion 141*a* of the ramp 141. Portion 141*a* is the highest end of the ramp 141 when viewed from the front as in FIG. 2, that is, it is the end of the ramp 141 that is closest to the diverter plate 150. In this embodiment, in this position the rotatable plate 140 is the shortest distance from the housing 110*a*. This negligible movement (or none at all) of the rotatable plate 140 in turn displaces the diverter plate 150 only a negligible amount (or none at all), and hence the shutter plates 130-131 only a negligible amount (or none at all). In turn, this means the force of the shutter plates 130-133 against the fixed support surface of the housing 110*b* is lower, reducing the friction force and allowing movement of the shutter plates 130-133 across the light path.

Rotating the rotatable plate 140, via rotation handle 145 in an anti-clockwise direction (as viewed from the front as in FIG. 2), causes each ball bearing 151 to slide up the corresponding ramp 141 towards the lowest end 141*b* of the ramp 141 (as viewed from the front as in FIG. 2). As the ball bearing 151 moves by sliding along the ramp 141, the rotatable plate 140 is displaced further in the axial direction L, which in turn displaces the diverter plate 150 in the axial direction L. This is best shown in FIG. 5 where the rotatable plate 140 has been rotated into the lock position. This sets the displacement of the diverter plate 150 (and thus shutter plates) along the longitudinal direction. The displacement of the diverter plate 150 set by rotation of the rotatable plate 140 into the lock position creates sufficient force to push the shutter plates against the fixed support surface (indirectly in this case but it could also be direct if the separator plates and further springs 175 were not employed for example) to generate the frictional force required to retain the shutter plates 130-133 and prevent them from further movement as discussed above.

Figure 6:
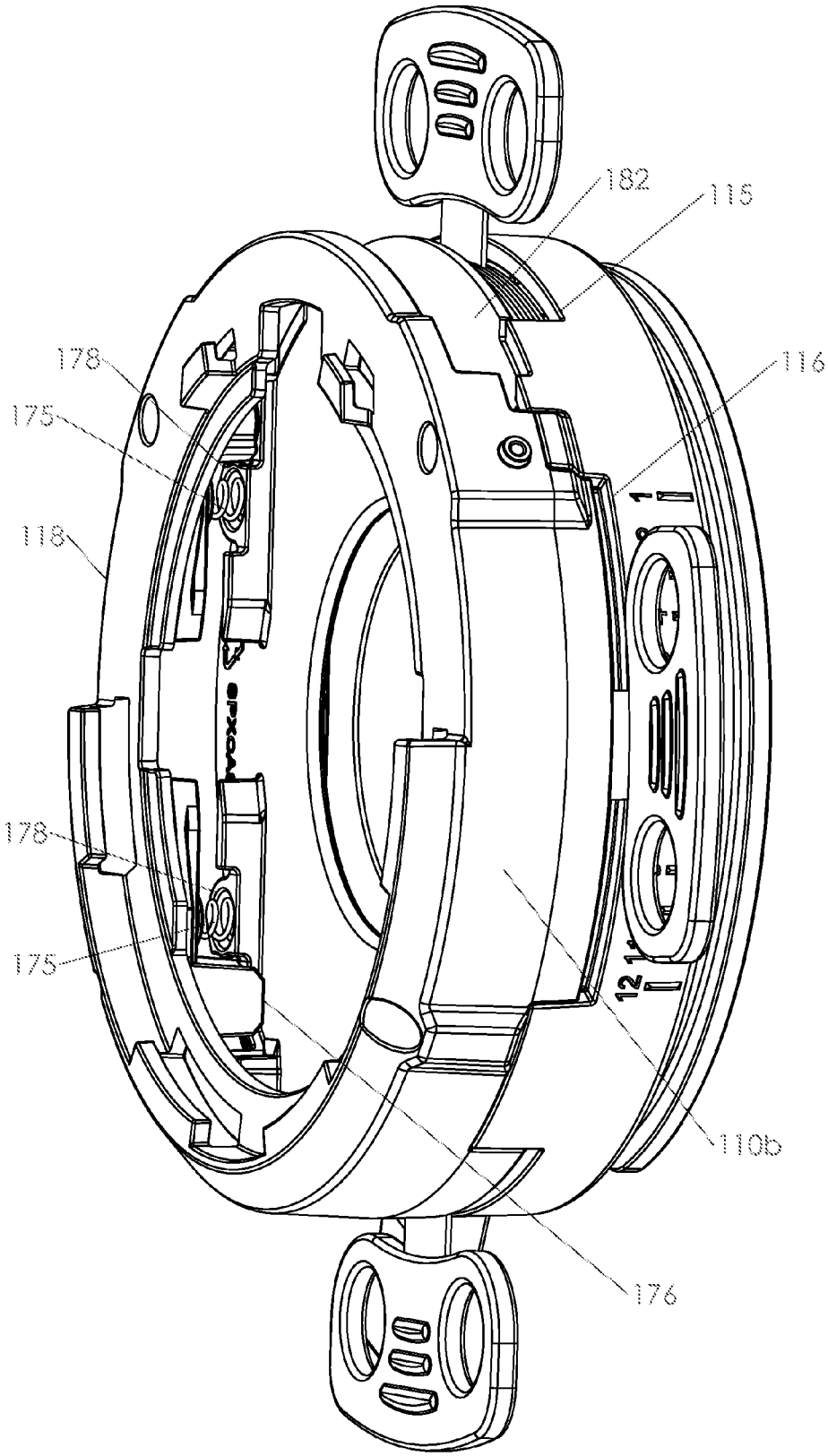
FIG. 6 is a frontal perspective view of the shutter assembly of FIG. 4 from a different angle with the housing.

In this embodiment, the shutter assembly 100 further comprises at least one spring element to bias the plates away from the fixed support surface in the axial direction. As shown in FIG. 3, a plurality of circumferentially spaced spring elements in the form of helical springs 175 are provided that each sit in a corresponding cup formation 178 projecting towards the housing 110*b*. This also contributes to the pre-tensioning of the shutter assembly 100, that is it increases the frictional force on the shutter plates 130-133 as the distance between the rotatable plate 140 and the housing casting plate 182 is now further decreased by the biasing action of the springs 175 which force the housing casting plate 182 in the opposite direction to the displacement set by the shutter lock 180. FIG. 6 shows the gap 176 formed between the housing casting plate 182 and the rim 112 due to the biasing action of the spring tab 175 after locking the shutter plates.

Figure 7:
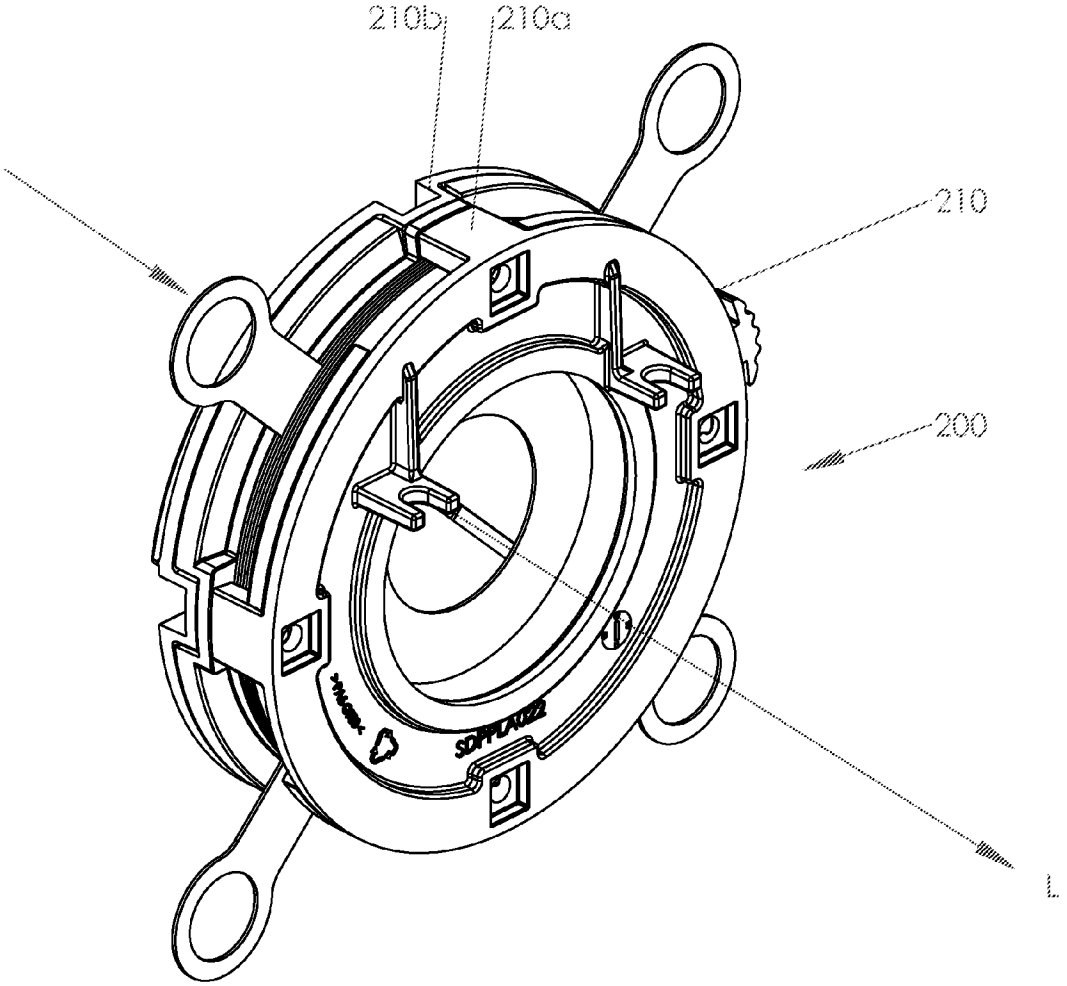
FIG. 7 is a perspective view of a second embodiment of a shutter assembly for the lighting apparatus of FIG. 1.

A second embodiment of a shutter assembly 200 of the present invention will now be described with reference to FIG. 7-9. FIG. 7 shows the shutter assembly 200 in the assembled form. The assembly comprises a housing 210 which retains the mechanism of the shutter assembly. The housing 210 can be a separate housing specifically formed for the shutter assembly 200, or it can be part of the housing of the lighting apparatus employing the shutter assembly 200. The housing 210 is generally formed by coupling two disk-like surfaces 210*a* and 210*b* and has a longitudinal axis and more generally a longitudinal direction L.

Figure 8:
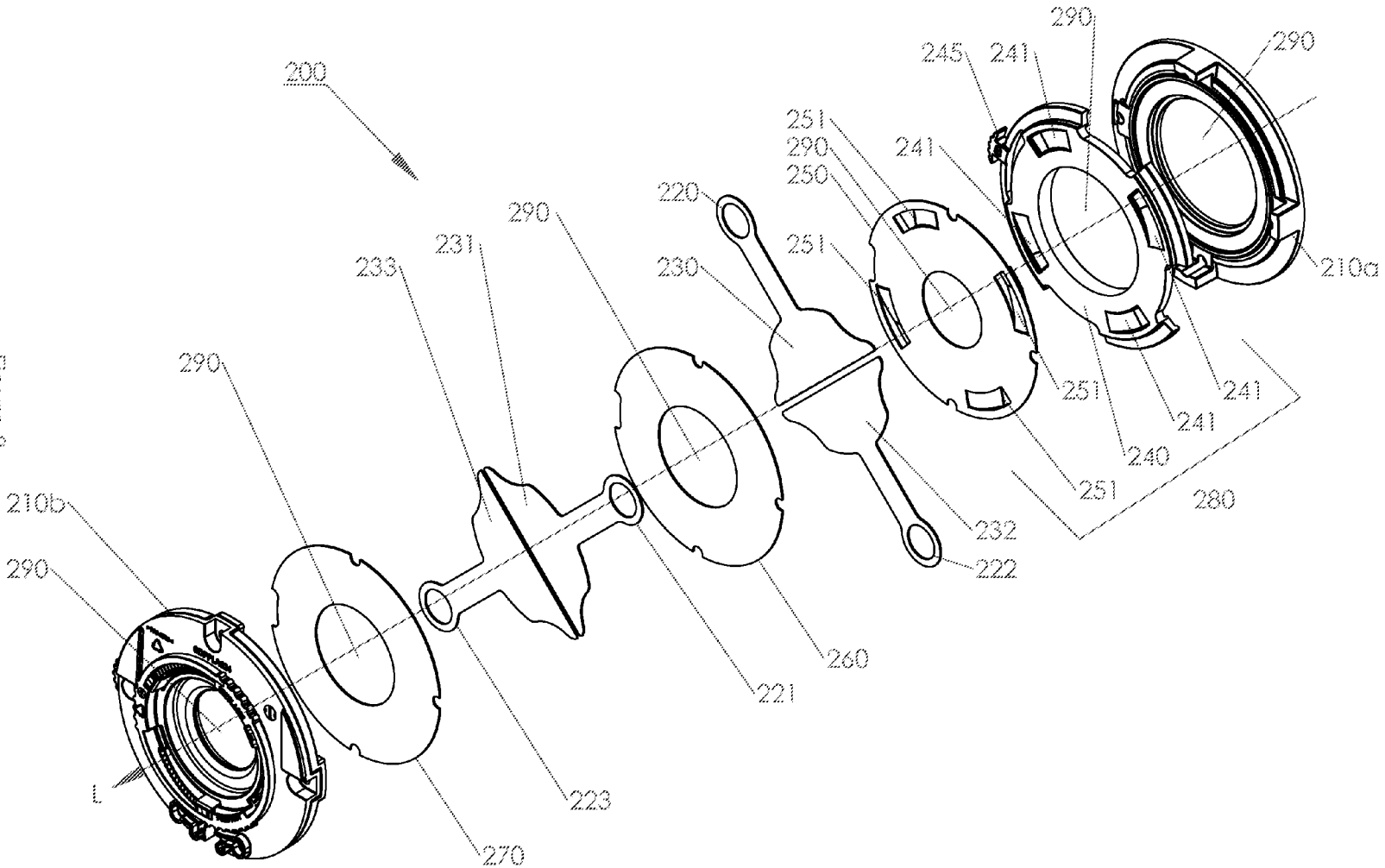
FIG. 8 is an exploded isometric frontal view of the shutter assembly of FIG. 7.

FIG. 8 shows the internal components housed in the shutter assembly 200. The housing 210 retains a shutter lock 280 formed from rotatable plate 240 and diverter plate 250, shutter plates 230-233 which can be any form of shutter plate known in the art, and first and second separator plates 260 and 270 respectively. The housing 210 and the plates retained within the housing (apart from the shutter plates) contain apertures 290 for allowing a light beam emanating from a lamp to traverse through.

Shutter plates 230-233 are moveable out of or at least partially within the path of the light beam to alter the shape of the light beam which exits the shutter assembly 200. Shutter plates 230-233 are moveable via movement of handles 220-223 respectively. Once the shutter plates 230-233 have been moved to their desired position, the shutter lock 280 can be used to retain the shutter plates 230-233 into position.

The shutter plates 230-233 are similar to those described above for the first embodiment. The principle by which the locking mechanism provided by the shutter lock 280 operates is the same as that described for the first embodiment above. The camming surfaces of this embodiment are provided on the rotatable plate 240 in the form of ramps 241 and the corresponding formations are provided on the diverter plate 250 in the form of spring tabs 251. In this embodiment, there is provided a plurality of circumferentially spaced helical ramps 241 on the rotatable plate 240, and corresponding helical spring tabs 251 on the diverter plate 250.

Figure 9:
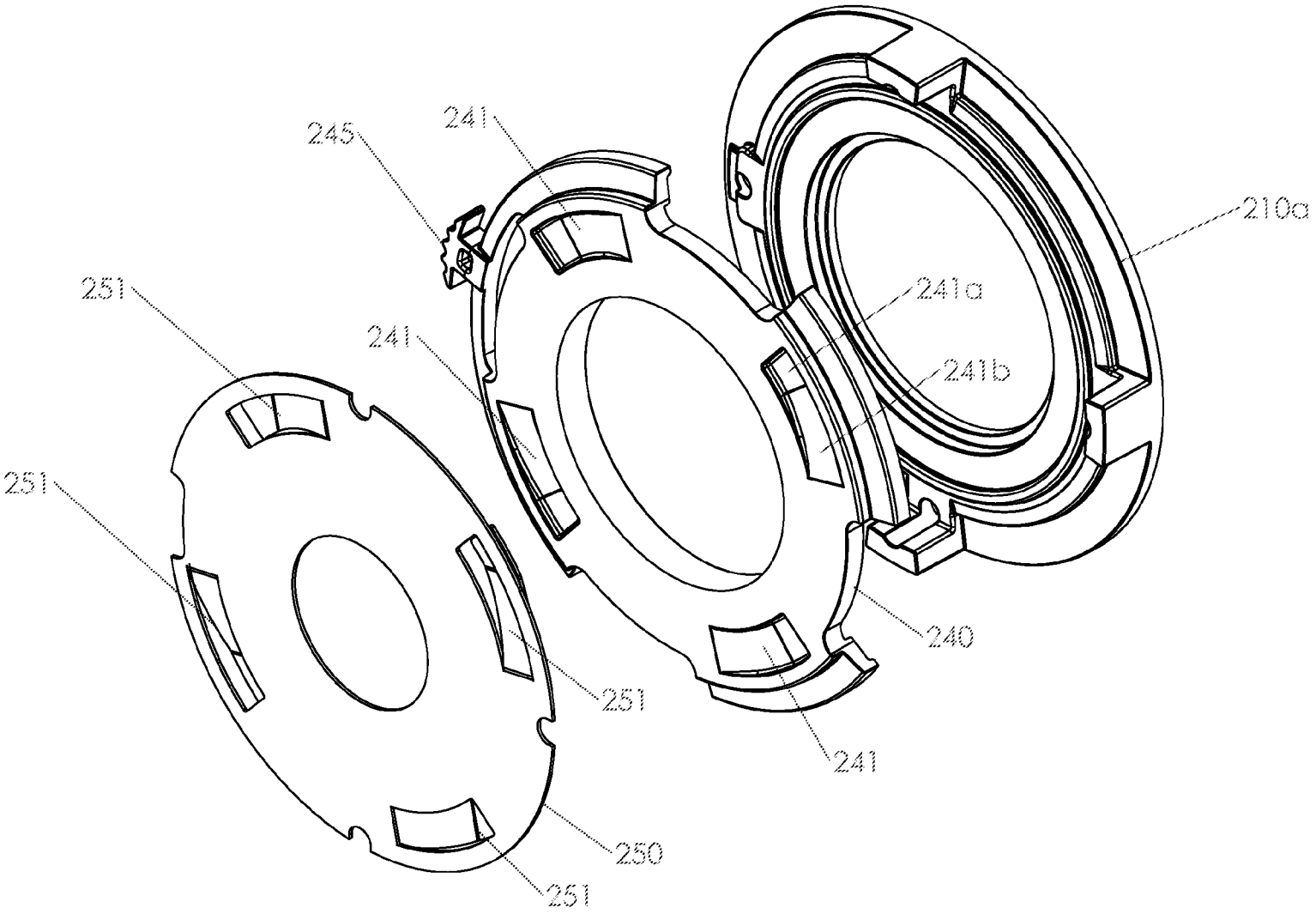
FIG. 9 is a close up of some of the elements of FIG. 8.

In the unlocked position, where the shutter plates 230-233 are free to move to alter the shape of the light beam by moving them across the light path, the spring tabs 251 of diverter plate 250, bear against the deepest portion 241*a* of helical ramps 241 of rotatable plate 240 (shown better in FIG. 9). Rotating the rotatable plate 240 via rotation handle 245 in an anti-clockwise direction as viewed from the front causes each tab 251 to slide along the corresponding ramp 241. As the tabs 251 slide along the ramps 241, the displacement of diverter plate 250 along the axial direction L is increased which in turn increases the frictional force between the plates as described above. In this embodiment the housing plate 210*b* provides the surface fixed in axial direction L. This friction makes it harder to move the shutter plates 230-233 and once the rotatable plate 240 reaches the rotational position by which the tabs 251 are at the shallowest part 241*b* of the corresponding ramps 241, the frictional force generated is sufficient to retain the shutter plates and prevent them from further movement. This is the lock position. In an alternative form of this embodiment sufficient force for locking the shutter plates might be achieved before the shallowest point 241*b* is reached by tabs 251. The spring tabs 251 provide additional displacement of the diverter plate 260 because of their natural biasing away from the rotatable plate 240. This embodiment also allows for gradual increase in frictional force between the plates of the assembly due to the ramp profile provided by the camming surfaces.

The foregoing description of the invention includes embodiments thereof. Modifications may be made thereto without departing from the scope of the invention. For example there may only be one shutter plate such that movement of the shutter plate still alters the beam of light exiting the shutter assembly.

Also in an alternative embodiment there are no separator plates such that the shutter plate(s) bear(s) directly against the fixed surface and bear(s) directly against the shutter lock.

As a further alternative, the diverter plate provides a plurality of circumferentially spaced dimples. The rotatable plate has corresponding formations in the form of twin diameter apertures, one aperture having a larger diameter than the other. The diameter of the dimple is sized between the diameter of the smaller and larger aperture and preferably significantly larger than the smaller sized aperture. In the unlocked position where the shutter plates are free to move to alter the shape of the light beam, the dimples of the diverter plate engage and protrude through the larger diameter apertures of the rotatable plate. In this position the rotatable plate is preferably flush or almost flush against the diverter plate. This displaces the diverter plate, and hence the shutter plates, only a negligible amount (or none at all).

Rotating the rotatable plate causes the smaller apertures to move towards the dimples. The dimples can only partially protrude through and engage the smaller apertures because of their size which in turn displaces the diverter plate in the axial direction. Since the formation does not engage as deeply in the smaller diameter aperture this displaces the diverter plate away from the rotatable plate. This displacement of the diverter plate is sufficient to push the shutter plates against the fixed support surface to generate the frictional force required to retain the shutter plates and prevent them from further movement.

The invention claimed is:

1. A shutter assembly for a lighting apparatus, the shutter assembly comprising:

an axial direction;

a light path for passage of light emanating from a light source;

at least one shutter plate moveable into a position external to or at least partially across the light path, wherein the shutter plate is rotated in a plane that is substantially perpendicular to the axial direction;

a rotatable shutter lock being rotatable to directly or indirectly generate a friction force on the shutter plate;

wherein the friction force generated on the shutter plate is dependent on the rotational position of the shutter lock and in at least one rotational position there is sufficient frictional force to retain the shutter plate in the position external to or across the light path; and, wherein the shutter lock comprises a rotatable plate which bears directly or indirectly against the shutter plate, wherein the rotational position of the rotatable plate sets the displacement of the shutter plate in the axial direction.

2. The shutter assembly according to claim 1 wherein the at least one rotational position is a lock position.

3. The shutter assembly according to claim 1 wherein the shutter assembly has an axial direction and the friction force is generated by the rotatable shutter lock retaining the shutter plate directly or indirectly against a support surface fixed in the axial direction.

4. The shutter assembly according to claim 3 wherein the shutter plate is retained directly or indirectly against the support surface by setting a displacement of the shutter plate in the axial direction relative to the support surface.

5. The shutter assembly according to claim 3 wherein the support surface forms part of a shutter housing.

6. The shutter assembly according to claim 1 wherein the shutter assembly has an axial direction and the rotational position of the shutter lock sets a displacement of the shutter plate in the axial direction.

7. The shutter assembly according to claim 1 wherein the shutter assembly has an axial direction and the axial direction is parallel to the axis of rotation of the shutter lock plate.

8. The shutter assembly according to claim 1 wherein the shutter lock comprises a central aperture that forms part of the light path.

9. The shutter assembly according to claim 1 wherein there are two pairs of opposed shutter plates, each pair of plates lying within a plane parallel to that of the other pair of plates across the light path and parallel to that of the shutter lock plate, and each plate of each pair of opposed shutter plates being moveable within its respective plane and in the first axial direction.

10. A shutter assembly for a lighting apparatus, the shutter assembly comprising:

a light path for passage of light emanating from a light source, at least one shutter plate moveable into a position external to or at least partially across the light path, and a rotatable shutter lock being rotatable to directly or indirectly generate a friction force on the shutter plate, wherein the friction force generated on the shutter plate is dependent on the rotational position of the shutter lock and in at least one rotational position there is sufficient frictional force to retain the shutter plate in the position external to or across the light path; and, wherein the shutter lock further comprises a diverter plate adjacent the rotatable plate, the diverter plate bears directly or indirectly against the shutter plate, and at least one of the rotatable plate and the diverter plate comprises at least one camming surface that bears against the other plate, wherein rotation of the rotatable plate causes the camming surface to set the displacement of at least the diverter plate in the axial direction, which in turn sets the displacement of the shutter plate in the axial direction.

11. The shutter assembly according to claim 10 wherein at least one of the rotatable plate and the diverter plate comprises a corresponding formation for each camming surface and each camming surface bears against a corresponding formation of the other plate.

12. The shutter assembly according to claim 11 wherein each camming surface is a ramp and the corresponding formation is a spring tab, wherein relative rotation of the rotatable plate and diverter plate causes each tab to slide along a corresponding ramp to displace the rotatable plate from the diverter plate.

13. A shutter assembly for a lighting apparatus, the shutter assembly comprising:

a light path for passage of light emanating from a light source, at least one shutter plate moveable into a position external to or at least partially across the light path, and a rotatable shutter lock being rotatable to directly or indirectly generate a friction force on the shutter plate, wherein the friction force generated on the shutter plate is dependent on the rotational position of the shutter lock and in at least one rotational position there is sufficient frictional force to retain the shutter plate in the position external to or across the light path;

wherein the rotatable plate comprises at least one camming surface that bears against a corresponding formation wherein rotation of the rotatable plate causes the camming surface to move relative to the corresponding formation to set the displacement of the shutter plate in the axial direction; and, wherein said corresponding formation comprises at least one pair of components, each pair consisting of a ball bearing that sits upon an open top of a helical spring.

14. A lighting apparatus, comprising a shutter assembly, the shutter assembly comprising:

an axial direction;

a light path for passage of light emanating from a light source of the lighting apparatus;

at least one shutter plate moveable into a position external to or at least partially across the light path, wherein the shutter plate is rotated in a plane that is substantially perpendicular to the axial direction;

a rotatable shutter lock being rotatable to directly or indirectly generate a friction force on the shutter plate;

wherein the friction force generated on the shutter plate is dependent on the rotational position of the shutter lock and in at least one rotational position there is sufficient frictional force to retain the shutter plate in the position external to or across the light path; and, wherein the shutter lock comprises a rotatable plate which bears directly or indirectly against the shutter plate, wherein the rotational position of the rotatable plate sets the displacement of the shutter plate in the axial direction.

15. A shutter assembly for a lighting apparatus, the shutter assembly comprising:

a light path for passage of light emanating from a light source, at least one shutter plate moveable into a position external to or at least partially across the light path, and a rotatable shutter lock being rotatable to directly or indirectly generate a friction force on the shutter plate, wherein the friction force generated on the shutter plate is dependent on the rotational position of the shutter lock and in at least one rotational position there is sufficient frictional force to retain the shutter plate in the position external to or across the light path;

wherein the shutter assembly has an axial direction and the shutter lock comprises a rotatable plate which bears directly or indirectly against the shutter plate, wherein the rotational position of the rotatable plate sets the displacement of the shutter plate in the axial direction; and, wherein the rotatable plate comprises an aperture, said aperture being a component of the light path.

16. A lighting apparatus, comprising a shutter assembly, the shutter assembly comprising:

a light path for passage of light emanating from a light source of the lighting apparatus, at least one shutter plate moveable into a position external to or at least partially across the light path, and a rotatable shutter lock being rotatable to directly or indirectly generate a friction force on the shutter plate, wherein the friction force generated on the shutter plate is dependent on the rotational position of the shutter lock and in at least one rotational position there is sufficient frictional force to retain the shutter plate in the position external to or across the light path;

wherein the shutter assembly has an axial direction and the shutter lock comprises a rotatable plate which bears directly or indirectly against the shutter plate, wherein the rotational position of the rotatable plate sets the displacement of the shutter plate in the axial direction; and, wherein the rotatable plate comprises an aperture, said aperture being a component of the light path.

* * * * *